US009914206B1

(12) United States Patent
Guirlinger

(10) Patent No.: US 9,914,206 B1
(45) Date of Patent: Mar. 13, 2018

(54) TOOL BAG

(71) Applicant: Edward G. Guirlinger, New Albany, OH (US)

(72) Inventor: Edward G. Guirlinger, New Albany, OH (US)

( * ) Notice: Subject to any disclaimer, the term of this patent is extended or adjusted under 35 U.S.C. 154(b) by 120 days.

(21) Appl. No.: 14/830,410

(22) Filed: Aug. 19, 2015

(51) Int. Cl.

| | |
|---|---|
| ***B65D 85/28*** | (2006.01) |
| ***B25H 3/00*** | (2006.01) |
| ***A45C 13/10*** | (2006.01) |
| ***A45C 13/26*** | (2006.01) |
| ***A45C 13/02*** | (2006.01) |

(52) U.S. Cl.
CPC ..... *B25H 3/00* (2013.01); *A45C 13/02* (2013.01); *A45C 13/10* (2013.01); *A45C 13/26* (2013.01)

(58) Field of Classification Search
CPC ..... B25H 3/00; A45C 13/02; A45C 13/10; A45C 13/26
USPC ..... 206/373
See application file for complete search history.

(56) References Cited

U.S. PATENT DOCUMENTS

| | | | | | |
|---|---|---|---|---|---|
| 4,294,348 | A * | 10/1981 | Hastings | A45C 11/24 | 206/1.7 |
| 4,550,828 | A * | 11/1985 | Baldwin | B25H 3/02 | 206/349 |
| 5,954,193 | A * | 9/1999 | Bartee | B44D 3/04 | 206/1.7 |
| 6,068,123 | A * | 5/2000 | Chen | B25H 3/028 | 206/373 |
| 6,085,902 | A * | 7/2000 | Fang | A45C 13/02 | 206/373 |
| 6,892,858 | B1 * | 5/2005 | Zupan | E06C 7/14 | 182/129 |
| 8,662,300 | B1 * | 3/2014 | Arena | B25H 3/00 | 206/372 |
| 2003/0085142 | A1 * | 5/2003 | Ouimette | B25H 3/00 | 206/373 |
| 2009/0008281 | A1 * | 1/2009 | Williams | B25H 3/00 | 206/373 |

* cited by examiner

*Primary Examiner* — Chun Cheung
(74) *Attorney, Agent, or Firm* — Lech Law, LLC; Robert R. Lech

(57) ABSTRACT

The tool bag of the present application comprises a rigid frame, a flexible cover and a removable container. The cover is disposed over the frame and the removable container passes through an aperture formed by one wall of the frame and the bottom of the frame.

13 Claims, 5 Drawing Sheets

TOOL BAG

TECHNICAL FIELD

The present application generally relates to devices and methods for storing and transporting collections of items. More specifically, the present application relates to a tool bag having certain advantageous features.

BACKGROUND

Tool boxes, tool bags, and tool belts are well known for storing and transporting a variety of items. Prior art utility tool boxes are useful for organizing and retaining tools small loose items, and they are typically constructed from solid materials such as metal, wood or hard plastic. Prior art tool bags and tool belts are typically constructed from flexible materials such as fabric or leather, and they are less prone to cracking and breaking. A need therefore exists for a tool bag which takes advantage of the characteristics of both solid tool boxes and flexible tool bags and tool belts.

SUMMARY

According to a first aspect of the present application, an example tool bag is disclosed. The first example tool bag comprises: a frame, a cover, and a removable container. The frame comprises a plurality of side walls including a first side wall, and a frame bottom. The first side wall cooperates with the frame bottom to form an aperture. The removable container is disposed above the frame bottom and below the first side wall, and the container is sized to be removable through the aperture.

The cover comprises an exterior cover portion, an interior cover portion and a bottom portion. The cover is disposed such that the exterior cover portion substantially covers an exterior surface of the at least one side wall of the frame. The cover is further disposed such that the interior cover portion substantially covers an interior surface of each of the at least one side wall of the frame. The cover is still further disposed such that the bottom portion is positioned above the removable first container.

According to a second aspect of the present application, an example tool bag is disclosed. The second example tool bag comprises: a frame; a removable container; and a cover. The frame comprises four rigid side walls including a first side wall, and a rigid frame bottom. Each side wall is connected to two adjacent side walls, and the first side wall cooperates with two adjacent side walls and the frame bottom to form an aperture.

The removable container is disposed above the frame bottom and below a lower edge of the first side wall. The container is sized to be removable through the aperture.

The cover comprises a flexible exterior cover portion, a flexible interior cover portion and a bottom portion comprising an integrated rigid panel. The cover is fastened to the frame and to itself, and the cover is disposed such that the exterior cover portion substantially covers an exterior surface of each of the four side walls. The cover is further disposed such that the interior cover portion substantially covers an interior surface of each of the four side walls. The cover is still further disposed such that the bottom portion is positioned above the removable container.

According to a third aspect of the present application, an example method for assembling a tool bag is disclosed. The example method includes: providing a frame; providing a cover; securing the cover to the frame; and inserting the removable container.

The frame comprises four rigid side walls including a first side wall, and a rigid frame bottom. Each side wall is connected to two adjacent side walls. The first side wall cooperates with two adjacent side walls and the frame bottom to form an aperture.

The cover comprises a flexible exterior cover portion; a flexible interior cover portion; a bottom portion comprising an integrated rigid panel; and an integrated handle assembly. The handle assembly comprises a grip portion, and a strap comprising attachment elements at a first end of the strap and a second end of the strap. The integrated strap passes between the exterior cover portion and the interior cover portion at two points.

Securing the cover to the frame comprises: attaching each attachment element to a side wall of the frame; covering the frame with the cover such that the exterior cover portion substantially covers an exterior surface of each of the four side walls; covering the frame with the cover such that the interior cover portion substantially covers an interior surface of each of the four side walls; and covering the frame with the cover such that the bottom portion is positioned above the aperture.

Securing the cover to the frame further comprises securing the exterior cover to the exterior surface of at least one side wall; and securing the exterior cover to itself. The method further comprises inserting the container into the aperture.

BRIEF DESCRIPTION OF THE DRAWINGS

The accompanying figures, which are incorporated in and constitute a part of the specification, illustrate various example apparatuses, systems, methods, and so on, and are used merely to illustrate various example embodiments. It should be noted that various components depicted in the figures may not be drawn to scale, and that the various assemblies and designs depicted in the figures are presented for purposes of illustration only, and should not be considered in any way as limiting.

DRAWING REFERENCE NUMERALS

Figure 1:
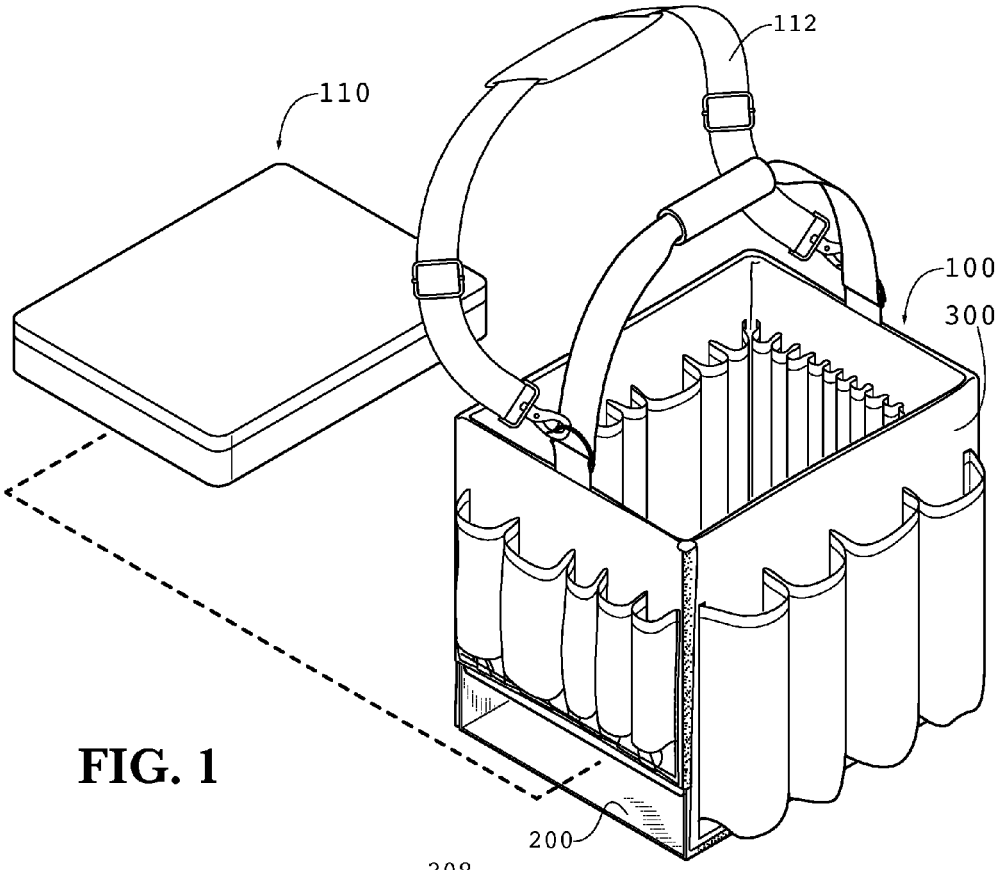
FIG. 1 illustrates a partially exploded, perspective view of an example tool bag.

The following reference characters identify the associated elements depicted in the drawings describing the present invention: 100 Example Tool Bag 110 Container/Parts Box 112 Shoulder Strap 200 Frame 202 Side Wall 203 Side Wall Edge Portion 204 Side Wall 206 Side Wall 207 Side Wall Edge Portion 208 Side Wall 209 Side Wall Lower Edge 210 Bottom 211 Edge 212 Aperture 214 Retention Element 216

Cover/Frame Fastener 232-238 Feet 242-248 Foot pads 300 Cover 302-308 Interior side surfaces 310 interior Tool Holder 312-318 Exterior side surfaces 320 Exterior Tool Holder 322 Interior Bottom 324 Rigid Panel 330 Handle Assembly 332 Strap 334 Grip 336 First End 338 Second End 340 First Attachment Element 342 Second Attachment Element 342 Door Side Retainer 350 Cover/Frame Fastener 352 Cover/Cover Fastener 354 Cover/Cover Fastener 360 Handle Fastener 362 Handle Fastener 600 Alternate Example Tool Bag 700 Assembly Method 702-714 Elements of Method

DETAILED DESCRIPTION

FIGS. 1-5C illustrate various aspects of an example tool bag 100. As shown in FIG. 1, tool bag 100 comprises a frame 200, a cover 300, a container or parts box 110, and a shoulder strap 112. Frame 200 provides primary structural support for the tool bag. Additional structural support is provided by parts box 110 and a rigid bottom panel integrated within cover 300, shown in more detail with reference to FIG. 3.

Figure 2:
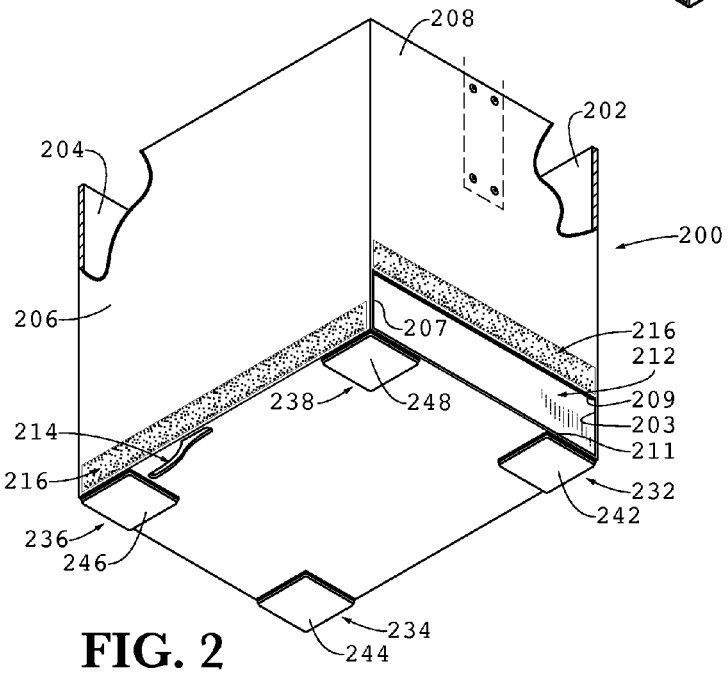
FIG. 2 illustrates a partially cutaway, perspective, bottom view of a frame of the example tool bag of FIG. 1.

FIG. 2 illustrates frame 200 of tool bag 100. In the example embodiment, frame 200 is a paneled frame comprising side walls 202, 204, 206 and 208 and a bottom 210. As illustrated, side walls 202, 204, and 206 cooperate with bottom 210 which provides vertical support to the cooperating side walls. The lower edge 209 of side wall 208 and the edge 211 of bottom 210 define the upper and lower portions of aperture 212. Aperture 212 is further defined by edge 207 of side wall 206 and edge 203 of side wall 202, and aperture 212 is sized to receive parts box 110.

Bottom 210 comprises optional integrated parts box retention element 214 for cooperating with and retaining parts box 110 when it is inserted into aperture 212. Although a single friction retention element is shown, alternate embodiments of tool bag 100 may include a plurality of such retention devices at various locations, or none at all. Further, while parts box retention element 214 is embodied as a friction-based device in the illustrated embodiment, retention element 214 may be embodied as any of a variety of well-known retention devices, including [Add list of alternatives here].

As illustrated, frame 200 further comprises a plurality of cover fasteners 216. In the example embodiment, cover fastener 216 is one portion of a pair of hook and loop retention strips. One having ordinary skill in the art will recognize that cover fastener 216 may be embodied as any of a number of various fasteners, including snaps, rivets, double-sided tape, or other similar fasteners.

FIG. 2 further illustrates optional feet 232, 234, 236 and 238 are attached to the underside of frame bottom 202. In the example embodiment, frame bottom 202 is molded to receive rubber pads 242, 244, 246 and 248. The rubber pads help to prevent tool bag 100 from unwanted sliding on surfaces when tool bag 100 is being used in various environments.

Figure 3:
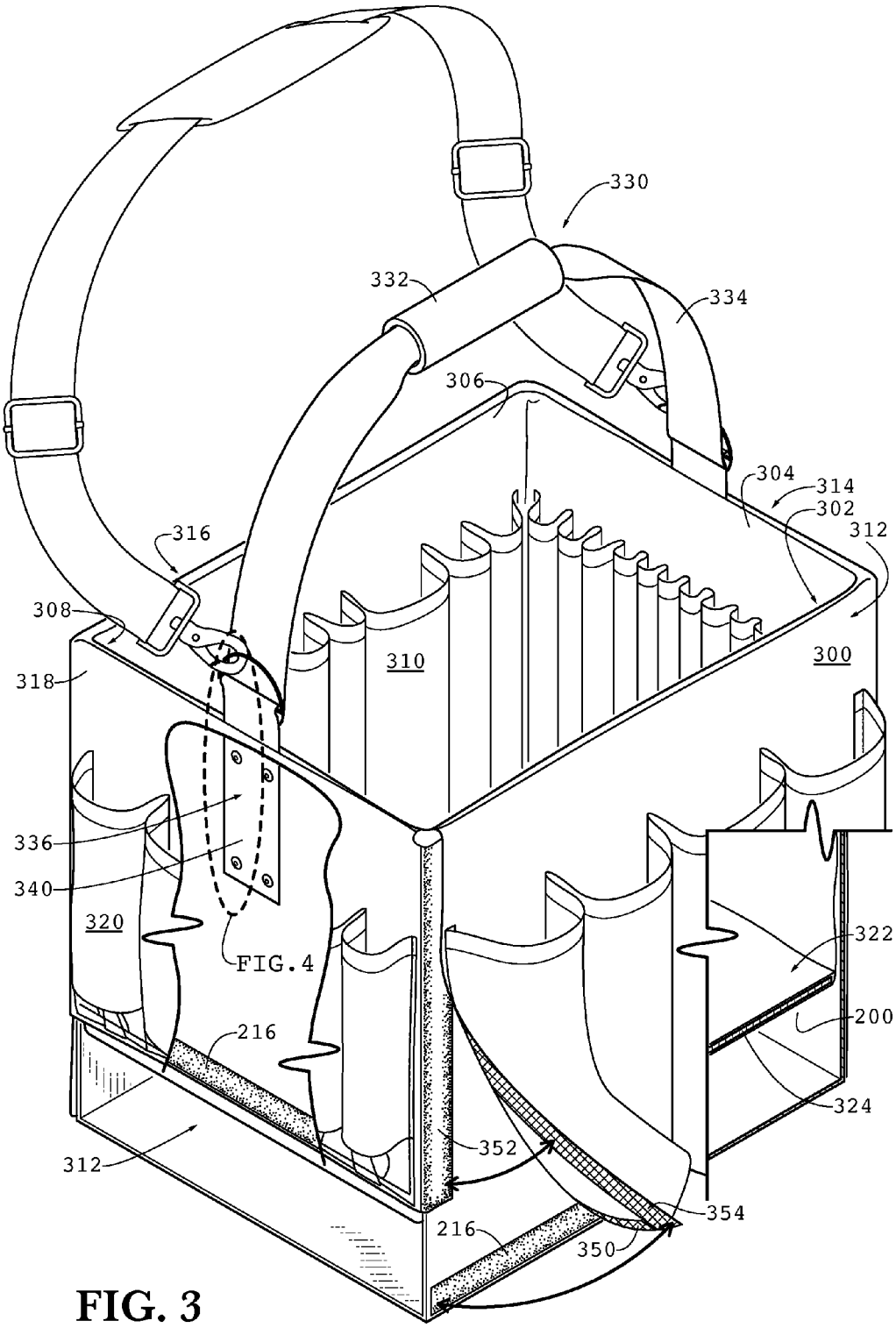
FIG. 3 illustrates a partially cutaway, perspective view of the example tool bag of FIG. 1.

The cover 300 of tool bag 100 is shown in more detail in FIG. 3. Cover 300 is constructed primarily from a relatively flexible fabric. Cover 300 is constructed to generally cooperate with the form of frame 200. As shown, cover 300 comprises interior side surface 302-308 which support a plurality of interior tool holders such as interior tool holder 310. Cover 300 also comprises exterior side surfaces 312-318 which support a plurality of exterior tool holders such as exterior tool holder 320.

The exterior surfaces 312-318 of cover 300 is sized to substantially cover the exterior surfaces of side walls 202, 204, 206 and 208 of frame 200. Accordingly, cover 300 is designed to leave aperture 212 unobstructed and available for receiving parts box 110. The interior surfaces 302-308 of cover 300 are sized to cover the upper interior portions of side walls 202, 204, 206 and 208 of frame 200. The interior surfaces 302-308 extend downward from the top of frame 300 to just above the bottom edge 209 of side wall 208.

An interior bottom 322 is attached to and disposed at the bottom edge of the interior surfaces 302-308. Integrated within the flexible fabric of cover 300, interior bottom 322 comprises a rigid panel 324 which defines the bottom of the interior space for storing tools and other items. The rigid panel 324 provides structural support to tool bag 100 and prevents obstruction of aperture 212 thereby ensuring that parts box 110 may be freely inserted and removed from tool bag 100.

Cover 300 further comprises an integrated handle assembly 330. The integrated handle assembly comprises a grip 332, and a strap 334. Strap 334 comprises a first end 336 and a second end (not shown) 338. Strap 334 further comprises a first attachment 340 element disposed at the first end 336 and a second attachment element (not shown) 342 disposed at the second end 338.

Cover 300 is secured to frame 200 at the first attachment element 340 and at the second attachment element 342. Cover 300 is further secured to frame 200 using fasteners 216 and fasteners 350. In order to provide a snug fit, cover 300 is secured to itself using fasteners 352 and 354.

Figure 4:
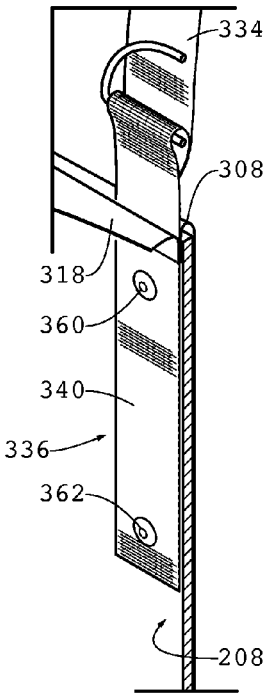
FIG. 4 illustrates a magnified view of a portion of the example tool bag of FIG. 1.

As illustrated more clearly in FIG. 4, first end 336 of strap 334 passes between exterior surface 318 and interior surface 308, and second end 338 (not shown) of strap 334 is similarly situated between exterior surface 316 and interior surface 306. Attachment elements 340 and 342 (not shown) are secured to frame side walls 204 and 208, as shown, using handle fasteners 360 and 362. Handle fasteners 360 and 362 are illustrated in the example embodiment as rivets, but they could be any type of fastener know to one having ordinary skill in the art.

Figure 5A:
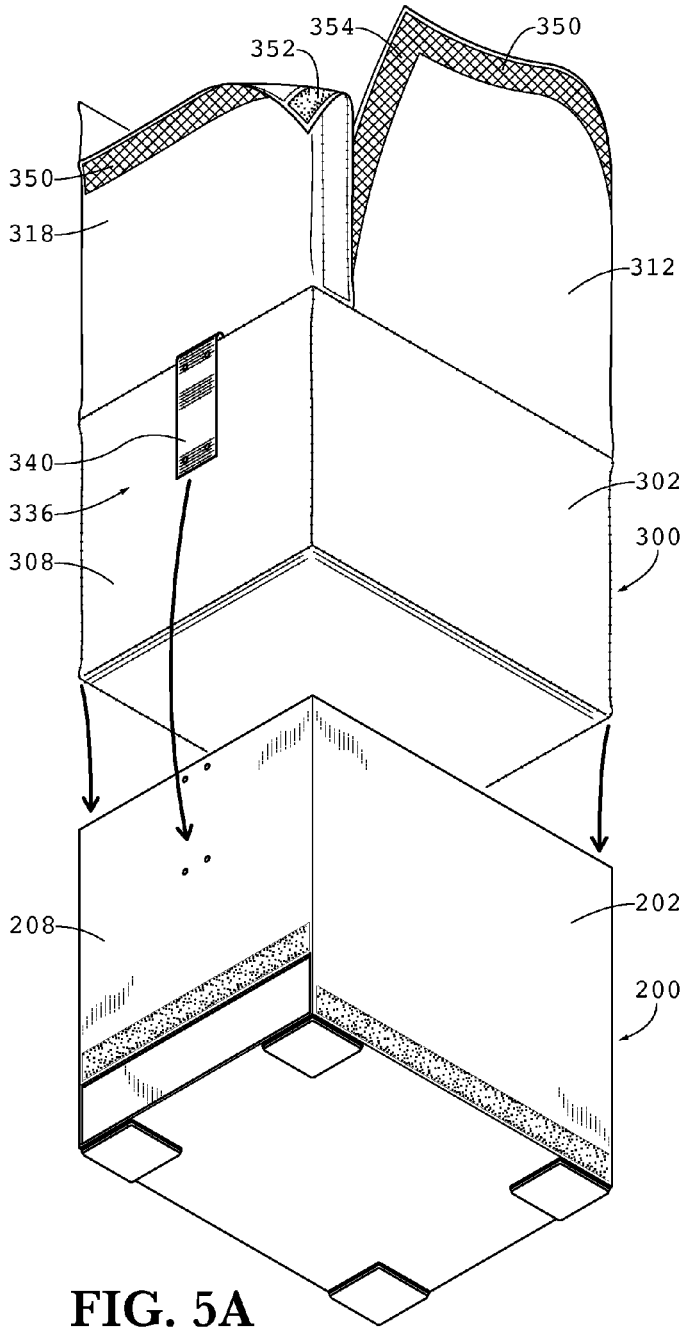
FIGS. 5A-5C illustrate successive perspective, bottom views illustrating the assembly of the example tool bag of FIG. 1.
Figure 5B:
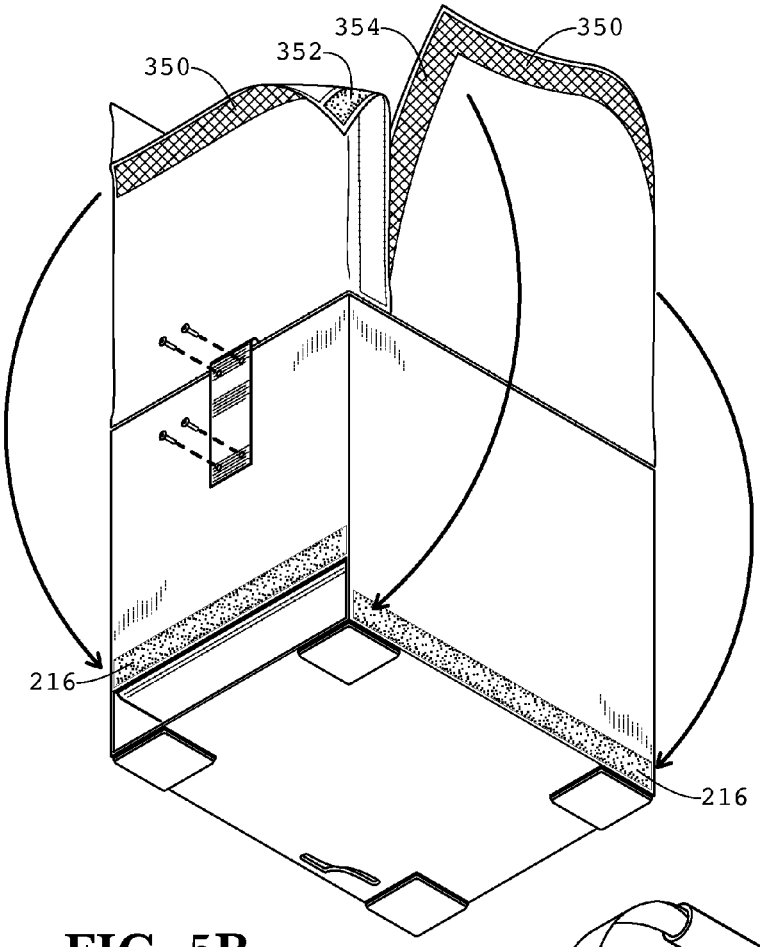
Figure 5C:
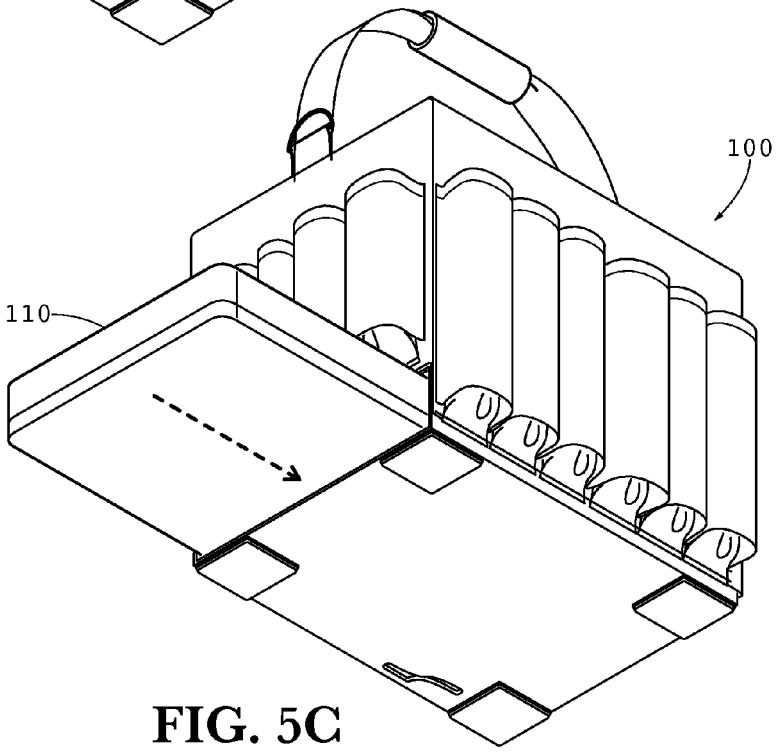

FIGS. 5A-5C illustrate example tool bag 100 in various stages of assembly. FIG. 5A illustrates frame 200 and cover 300 prior to assembly. Exterior surfaces 312-318 of cover 300 are raised up to provide access to attachment elements 340 and 342. Interior surfaces 302-308 of cover 300 are lowered into a cavity formed by sidewalls 202, 204, 206, and 208 of frame 200. Attachment elements 340 and 342 are secured side walls 204 and 208 of cover 300, respectively.

As shown in FIG. 5B, exterior surfaces 312-318 of cover 300 are flipped downward so that they are in close proximity with and cover the exterior portions of side walls 202, 204, 206, and 208 of frame 200. Exterior surfaces 312-318 of cover 300 are further fitted and secured to frame 200 so that the exterior surfaces 312-318 of cover 300 are in close proximity to the exterior surfaces of frame side walls 202-208, respectively.

When cover 300 is fitted over frame 200, cover 300 is secured to frame 200 with one or more fasteners, such as fasteners 216 and 350. In the example embodiment, fastener 350 is one portion of hook and loop style fastener that cooperates with fastener 216 to secure cover 300 in place relative to frame 200. Optionally, cover 300 may also comprise fasteners, such as fasteners 352 and 354 that secure one portion of cover 300 to another portion of cover 300. Such fasteners enable cover 300 to maintain a tight fit around frame 200.

Although fasteners 216, 350, 352 and 354 are illustrated as hook and loop fasteners, one having ordinary skill in the art will recognize that they may be embodied as any of a number of various fasteners, including snaps, rivets, double-sided tape, or other similar fasteners.

Figure 6:
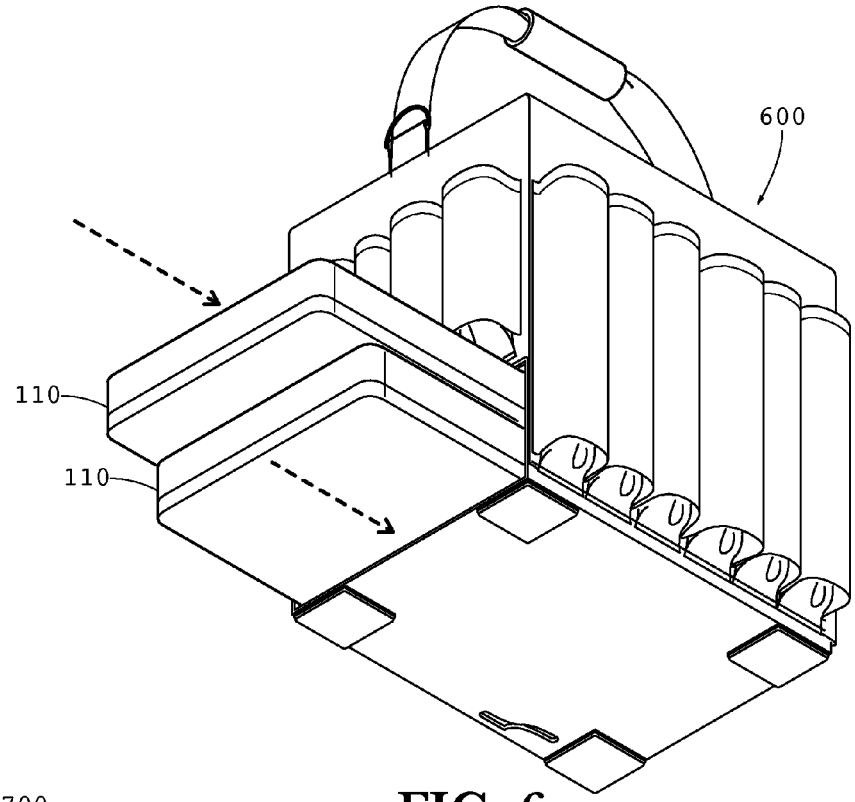
FIG. 6 is a perspective, bottom view of an alternate example tool bag.

FIG. 5C illustrates that container 110 is inserted into aperture 212 to complete a fully assembled example tool bag 100. FIG. 6 illustrates an alternate example tool bag 600 which is substantially similar to example tool bag 100 except that tool bag 600 comprises a plurality of removable containers 110. The removable containers 110 of tool bag 600 may be identical to one another, as shown, or may have different dimensions and/or configurations to accommodate holding different types of items.

Figure 7:
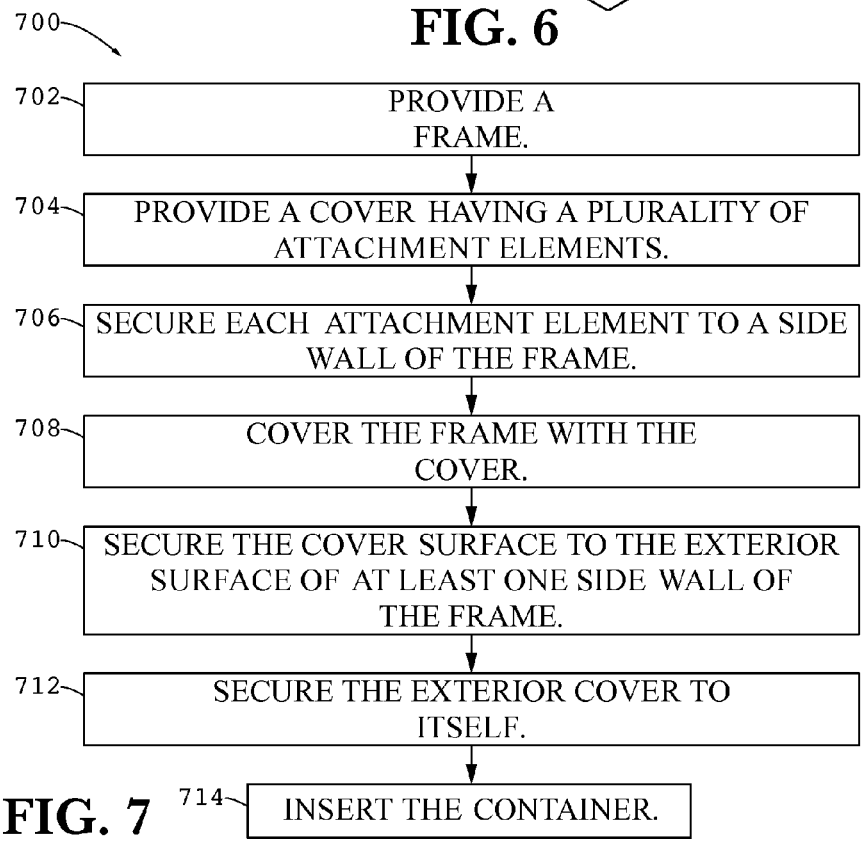
FIG. 7 is a flow diagram illustrating the method of assembling the example tool bags of FIGS. 1 and 6.

Referring now to FIG. 7, there is a flow diagram illustrating a method 700 for assembling a tool bag such as example tool bags 100 and 600. The method comprises providing a frame 702. The frame comprises four rigid side walls including a first side wall, and a rigid frame bottom. Each side wall is connected to two adjacent side walls. The first side wall cooperates with two adjacent side walls and the frame bottom to form an aperture.

Method 700 further comprises providing a cover (704). The cover comprises: a flexible exterior cover portion; a flexible interior cover portion; a bottom portion comprising an integrated rigid panel; and an integrated handle assembly. The handle assembly comprises a grip portion, and a strap. The strap comprises attachment elements at a first end of the strap and a second end of the strap, and the strap passes between the exterior cover portion and the interior cover portion at two points.

Method 700 further comprises securing each attachment element to a side wall of the frame (706) and covering the frame with the cover (708). Covering the frame with the cover is accomplished such that: the exterior cover portion substantially covers an exterior surface of each of the four side walls; the interior cover portion substantially covers an interior surface of each of the four side walls; and the bottom portion is positioned above the aperture.

Method 700 still further comprises securing the exterior cover to the exterior surface of at least one side wall (710); securing the exterior cover to itself (712); and inserting the container into the aperture (714).

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Furthermore, while the devices, systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A tool bag comprising:

a frame, the frame comprising a plurality of side walls including a first side wall, and a frame bottom, the first side wall cooperating with the frame bottom to form an aperture;

a first removable container disposed above the frame bottom and below the first side wall, the first container sized to be removable through the aperture; and a cover, the cover comprising an exterior cover portion, an interior cover portion and a bottom portion, the bottom portion comprising an integrated rigid panel, the cover disposed such that the exterior cover portion substantially covers an exterior surface of each of the plurality of side walls, the cover further disposed such that the interior cover portion substantially covers an interior surface of each of the plurality of side walls, the cover still further disposed such that the bottom portion is positioned above the first removable container.

2. The tool bag of claim 1 wherein the plurality of side walls comprises four side walls.

3. The tool bag of claim 1 further comprising at least one fastener fastening the cover to the frame.

4. The tool bag of claim 1 further comprising at least one fastener fastening a first portion of the cover to a second portion of the cover.

5. The tool bag of claim 1 wherein the cover comprises an integrated handle, and the integrated handle is fastened to the frame.

6. The tool bag of claim 1 further comprising a plurality of feet attached to a bottom of the frame bottom.

7. The tool bag of claim 1 further comprising a second removable container disposed above the first removable container, wherein the aperture is sized to accommodate removal of both the first removable container and the second removable container.

8. The tool bag of claim 1 wherein the frame comprises a retention element cooperating with the first removable container to maintain the position of the first removable container when the first removable container is fully inserted through the aperture.

9. A tool bag comprising:

a frame, the frame comprising four rigid side walls including a first side wall, and a rigid frame bottom, each side wall is connected to two adjacent side walls, the first side wall cooperating with two adjacent side walls and the frame bottom to form an aperture;

a first removable container disposed above the frame bottom and below a lower edge of the first side wall, the first container sized to be removable through the aperture; and a cover, the cover comprising a flexible exterior cover portion, a flexible interior cover portion and a bottom portion comprising an integrated rigid panel; and wherein a first portion of the cover is fastened to the frame and to a second portion of the cover, and the cover is disposed such that the exterior cover portion substantially covers an exterior surface of each of the four side walls, the cover is further disposed such that the interior cover portion substantially covers an interior surface of each of the four side walls, the cover is still further disposed such that the bottom portion is positioned above the first removable container.

10. The tool bag of claim 9 wherein the cover comprises an integrated handle, and the integrated handle is fastened to the frame.

11. The tool bag of claim 9 further comprising a plurality of feet attached to a bottom of the frame bottom.

12. The tool bag of claim 9 further comprising a second removable container disposed above the first removable container, wherein the aperture is sized to accommodate removal of both the first removable container and the second removable container.

13. A method for assembling a tool bag comprising:

providing a frame, the frame comprising four rigid side walls including a first side wall, and a rigid frame bottom, each side wall is connected to two adjacent side walls, the first side wall cooperating with two adjacent side walls and the frame bottom to form an aperture;

providing a cover, the cover comprising:

a flexible exterior cover portion, a flexible interior cover portion, a bottom portion comprising an integrated rigid panel, and an integrated handle assembly comprising a grip portion, and a strap comprising attachment elements at a first end of the strap and a second end of the strap, the integrated strap passing between the exterior cover portion and the interior cover portion at two points;

securing each attachment element to a side wall of the frame;

covering the frame with the cover such that:

the exterior cover portion substantially covers an exterior surface of each of the four side walls, the interior cover portion substantially covers an interior surface of each of the four side walls, and the bottom portion is positioned above the aperture;

securing the exterior cover to the exterior surface of at least one side wall;

securing the exterior cover to itself; and inserting the container into the aperture.

* * * * *